US007021105B2

(12) United States Patent
Drigani et al.

(10) Patent No.: US 7,021,105 B2
(45) Date of Patent: Apr. 4, 2006

(54) DEVICE AND METHOD TO BEND THE ROLLS IN A ROLLING STAND

(75) Inventors: Fausto Drigani, Zugliano-Pozzuolo Del Friuli (IT); Stanislaw Pawlowski, Mulheim An der Ruhr (DE); Enrico Ventulini, Nespoledo (IT)

(73) Assignee: Danieli & C. Officine Meccaniche SpA, Buttrio (IT)

( * ) Notice: Subject to any disclaimer, the term of this patent is extended or adjusted under 35 U.S.C. 154(b) by 285 days.

(21) Appl. No.: 10/381,100

(22) PCT Filed: Sep. 20, 2001

(86) PCT No.: PCT/IB01/01727

§ 371 (c)(1),
(2), (4) Date: Mar. 21, 2003

(87) PCT Pub. No.: WO02/24358

PCT Pub. Date: Mar. 28, 2002

(65) Prior Publication Data

US 2004/0011110 A1 Jan. 22, 2004

(30) Foreign Application Priority Data

Sep. 25, 2000 (IT) ..... UD2000A0178

(51) Int. Cl.
*B21B 29/00* (2006.01)

(52) U.S. Cl. ..... 72/241.8; 72/245

(58) Field of Classification Search ..... 72/241.6, 72/241.8, 245
See application file for complete search history.

(56) References Cited

U.S. PATENT DOCUMENTS

| | | | | |
|---|---|---|---|---|
| 4,627,261 | A * | 12/1986 | Schiller | 72/241.8 |
| 4,934,166 | A | 6/1990 | Giacomoni | |
| 5,638,716 | A | 6/1997 | Jonen | |
| 6,112,569 | A | 9/2000 | Ossendorf | |

FOREIGN PATENT DOCUMENTS

| | | |
|---|---|---|
| DE | 3245031 | 6/1984 |
| GB | 2024682 | 1/1980 |
| JP | 58000307 | 1/1983 |
| JP | 61159211 | 7/1986 |
| JP | 62009708 | 1/1987 |
| JP | 03032410 | 2/1991 |
| WO | 9965621 | 12/1999 |

* cited by examiner

*Primary Examiner*—Lowell A. Larson
(74) *Attorney, Agent, or Firm*—Stevens, Davis, Miller & Mosher, LLP

(57) ABSTRACT

A device to bend the rolls in a rolling stand, wherein each roll to be bent is rotatably mounted in two corresponding chocks each associated to two series of two double-effect actuators, for a total of four actuators for each chock. Each actuator is disposed on opposite sides of the corresponding chock with respect to the axis of rotation (Y) of the roll to be bent.

8 Claims, 6 Drawing Sheets

DEVICE AND METHOD TO BEND THE ROLLS IN A ROLLING STAND

FIELD OF THE INVENTION

The invention concerns a device and a method to achieve bending of the rolls, both positive (in) and negative (out), in a rolling stand, advantageously of the working rolls.

BACKGROUND OF THE INVENTION

In a conventional rolling stand, for example in a four-high or six-high stand with both positive and negative bending of the working rolls WR, the bending force is generally managed, for each chock, by means of four, six or eight actuators or hydraulic jacks A (FIG. 1*a*).

The actuators A are single effect and therefore two (or four) of them thrust the upper chock GWR upwards (positive bending), while two (or four) of them thrust the same upper chock GWR downwards (negative bending).

Normally, considering the forces in play required to perform an effective "mechanical" rounding of the working rolls, the piston of each actuator is rather bulky, so that this solution is limited with regard to the maximum bending force applicable to the working roll. Moreover, this conventional solution requires that seatings be made (in the housing or in blocks connected to the housing) above and below the fins D of the chocks GWR of the working rolls WR. The bulk may be such that the solution with both positive and negative bending becomes difficult, especially in stands where the working rolls WR must also be displaced axially (shifting).

Very often, considering the limits of space, it is necessary to manage without applying negative bending, thus considerably reducing (by about a half) the capacity to dynamically control the strip profile which can be obtained with both positive and negative bending.

The presence of play and friction usually causes an indetermination in the passage from negative bending to positive bending and vice versa, unless particular strategies are adopted such as the one we shall now illustrate.

With reference to the diagram in FIG. 2, which refers to a conventional embodiment, for example that shown in FIG. 1*a*, where the x-axis shows the desired total bending force (FTD) and the y-axis shows the actual total bending force (FTE), if the total bending has to be negative, pressure is applied to the negative bending hydraulic jacks and the positive bending hydraulic jacks are kept on zero. If the total bending is to be positive, a symmetrically opposite approach is used.

As we have seen, however, due to the play and friction, a management of this type creates an area of indetermination AI, or grey area, around the zero.

In other words, it is impossible to be sure of the real value of the actual total bending force (FTE) in the shaded area AI in FIG. 2, with respect to the desired bending force (FTD).

In a conventional embodiment, for example that shown in FIG. 1*a*, to eliminate the problem illustrated above and to obtain a substantially linear resulting force F (FIG. 3), it is possible to manage the forces as follows.

When the total bending is positive, the negative bending hydraulic jacks generate a constant negative force, while simmetrically the opposite happens when the total bending is negative.

The state of the art comprises document JP-A-62009708, which discloses a roll bending device wherein, for each roll chock, a plurality of double-effect actuators are interposed between an upper fin and a lower fin of the chock. When the working rolls are rearranged, a lower reinforcing roll is moved down and an upper reinforcing roll is moved up by a balance cylinder. By means of two actuators, the chock of the upper working roll is moved up and the chock of the lower working roll is moved down to the lowermost position. By that operation, a first lateral wheel of the chock of the lower working roll is ridden on a rearranging rail, so that the same chock is able to be pulled out. On the other hand, the upper fin of the chock of the upper roll is supported by the piston rod of the corresponding actuator and a first gap is generated between the arm and the piston rod of the other actuator. A second gap is generated between a second wheel set on the upper fin of the chock of the upper working roll and a rearranging rail. This device, even if it uses double-effect actuators, is very complicated and cumbersome and does not provide for the control of small forces to obtain bending around the zero position.

The present Applicant has devised the device according to the invention to overcome these shortcomings.

SUMMARY OF THE INVENTION

The device and method to bend rolls in a rolling stand according to the invention are set forth and characterized in the respective main claims, while the dependent claims describe other innovative characteristics of the invention.

Before describing the invention, it is appropriate to make some prior considerations.

One purpose of the invention is to achieve a device to obtain a controlled bending, both positive and negative, of the rolling rolls, and in particular of the working rolls, in a rolling stand, which will be effective and at the same time of limited size.

Another purpose of the invention is to achieve a device to bend the rolling rolls which is mechanically simple and allows to obtain wide bending, both static and dynamic and irrespective of whether it is negative or positive, and thus to amplify significantly and decisively the field of regulation of the crown and the planarity of the product.

In accordance with said purposes, the device according to the invention uses a configuration in which the bending actuators are double-effect type (FIG. 1*b*). Hence the space needed for the installation of the actuators is limited compared with the conventional solution according to the state of the art (FIG. 1*a*). The space occupied is thus reduced and at the same time the capacity to perform positive and negative bending is maintained.

In a rolling stand in which, for reasons of space, it is necessary to adopt a configuration like that shown in FIG. 1*b*, with double-effect hydraulic jacks and with a hammer head (to attach to the chock), the situation is more complicated. It becomes difficult to control bending around zero unless a solution is adopted with six hydraulic jacks for each chock, but still with a particular management of the bending forces of each hydraulic jack.

In substance it is necessary: (a) to prevent the hammer head hydraulic cylinder from working in a zone where friction and play render insecure the value of the force F actually transmitted by the jacks to the chock; (b) to keep the actual total bending force (FTE) aligned on the axis of the bearing of the working roll.

For point (a) it is necessary to manage the pressures in the two chambers of the hydraulic jack as indicated in FIGS. 4, 5*a* and 5*b*. The hydraulic jack can apply either a negative or positive force; N indicates a hydraulic jack A when it applies a negative force, whereas P indicates a hydraulic jack B when it applies a positive force.

In a configuration with four jacks for each chock, when jack B (FIGS. 4, 5*a* and 5*b*) approaches the area of indetermination AI, it is managed with a negative bending force F− which is greater than needed, whereas, simultaneously, jack A generates a greater positive bending force F+ such as to balance the total result. In this way the passage into the area of indetermination AI is achieved with the "plays" having been recovered.

To respect the above condition (b), six hydraulic jacks can be used for each chock GWR, as shown in FIGS. 6 and 7. In this way no torques are generated in the bearing of the working roll WR.

With six jacks A the area of indetermination AI is managed as shown in FIG. 8 and the forces in play, for every single point $F_R$, are those shown in FIG. 9.

It is also possible to adopt a solution with four jacks A for each chock GWR. In this case the jacks A are managed differently between the inlet side of the rolling stand and the outlet side thereof, as shown in FIGS. 10, 11 and 12, so that the force occurring on the bearing of the working roll WR is still aligned with the intersection between the central axis $C_L$ of the bearing and the rotation axis Y of the working roll.

Therefore, the device according to the invention comprises two series of actuators for each chock associated with the rolls to be bent, each series being arranged on opposite sides of the corresponding chock with respect to the axis of rotation of the roll to be bent.

The actuators are double-effect actuators and are housed in two drawing sectors associated with the corresponding housing of the rolling stand.

Each actuator comprises a cylindrical rod provided with a hammer head at one end thereof. The cylindrical rod is axially moved by command means of a fluid-dynamic type.

The hammer heads of the two rods of each pair of actuators are housed, advantageously with play, in the same longitudinal through groove made on one side of the chock. The two grooves of the same chock are parallel, so as to make it easy to remove the corresponding roll.

The travel of the cylindrical rods is sufficient both to bend the roll in both directions and also to recover the play between the hammer heads and the corresponding groove.

BRIEF DESCRIPTION OF THE DRAWINGS

These and other characteristics of the invention will become clear from the following description of a preferred form of embodiment, given as a non-restrictive example with reference to the attached drawings wherein:

FIGS. 4–12 represent diagrams able to show the behaviour of the forces in play in the device according to the invention, with double-effect bending actuators;

To be more exact, FIGS. 5*a*, 5*b*, 7, 13 and 14 show the position of the hydraulic jacks when working with bending in the area of indetermination AI.

DETAILED DESCRIPTION OF A PREFERENTIAL EMBODIMENT

Figure 1A:
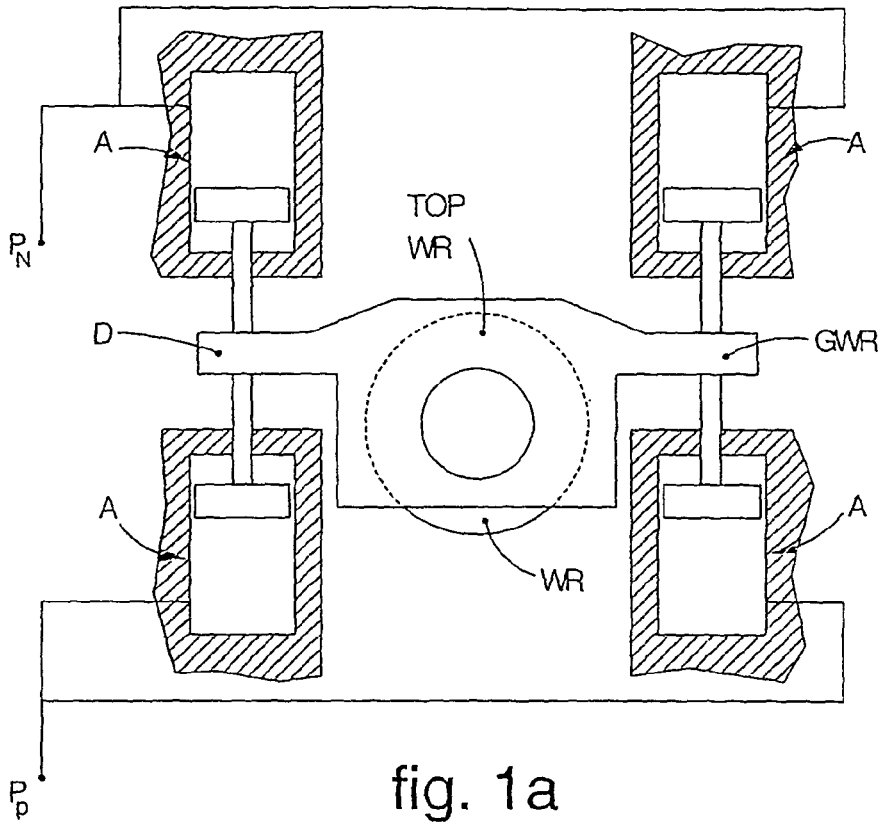
FIG. 1*a* is a schematic view of a device to bend the rolls in a rolling stand, according to the state of the art.
Figure 1B:
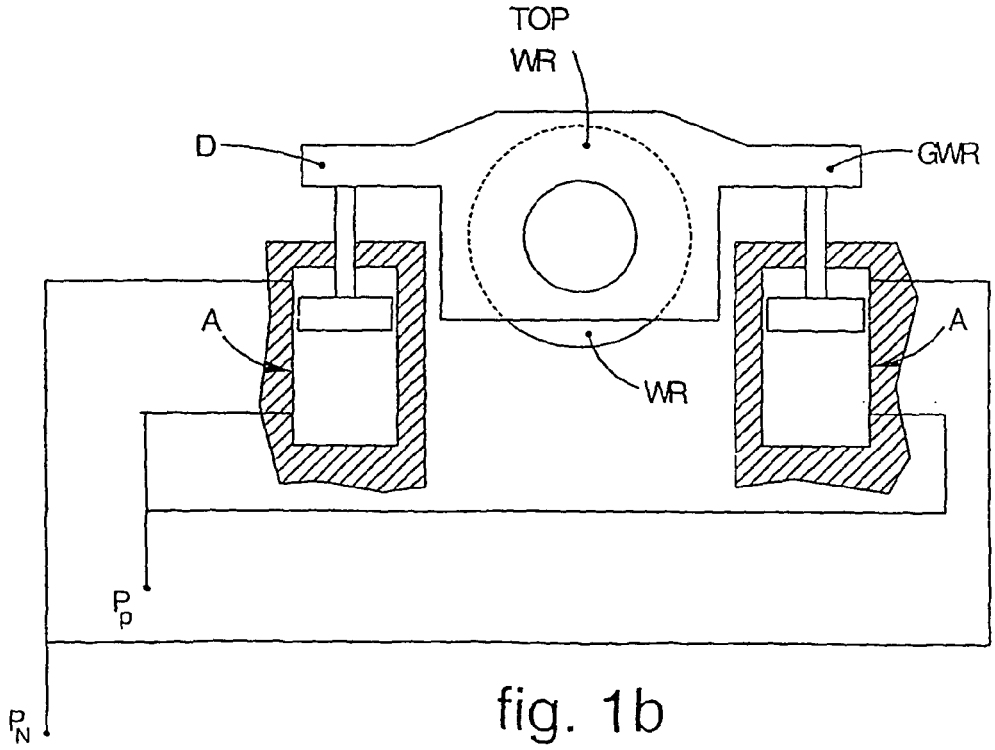
FIG. 1*b* is a schematic view of a device to bend the rolls in a rolling stand, according to the invention.
Figure 2:
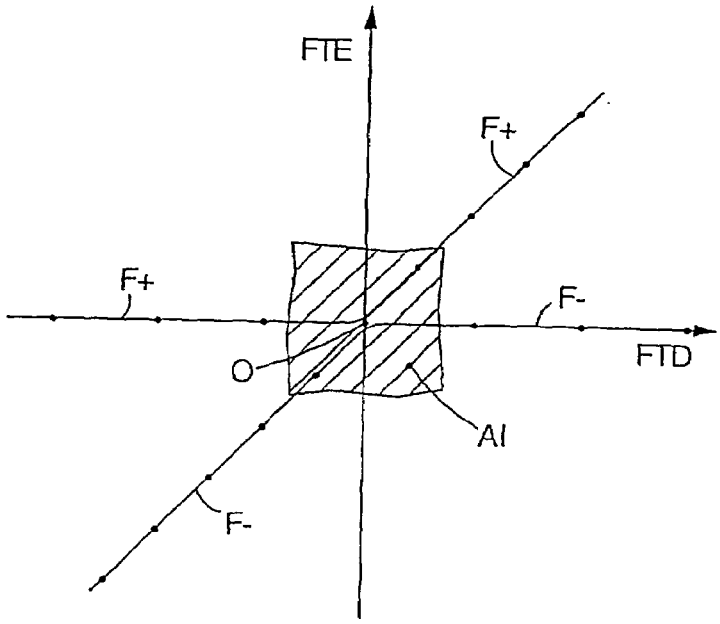
FIGS. 2 and 3 represent diagrams able to show the behaviour of the forces in play in conventional devices.
Figure 3:
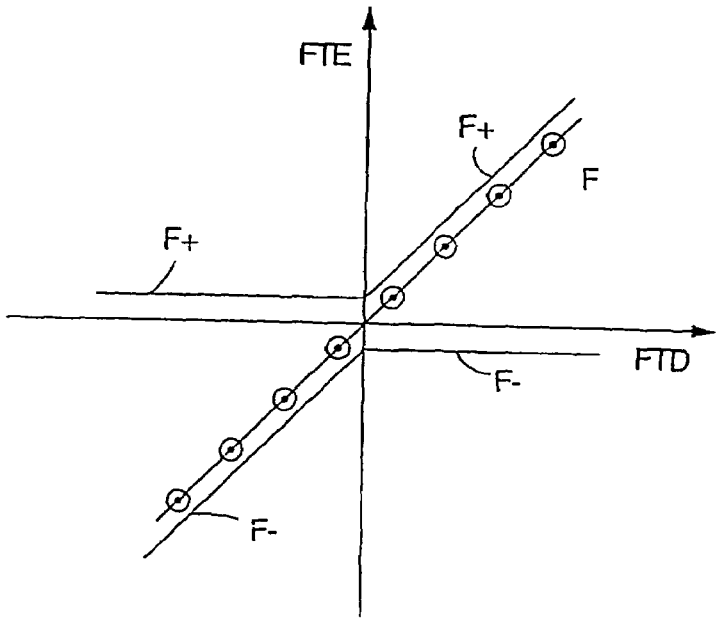
Figure 4:
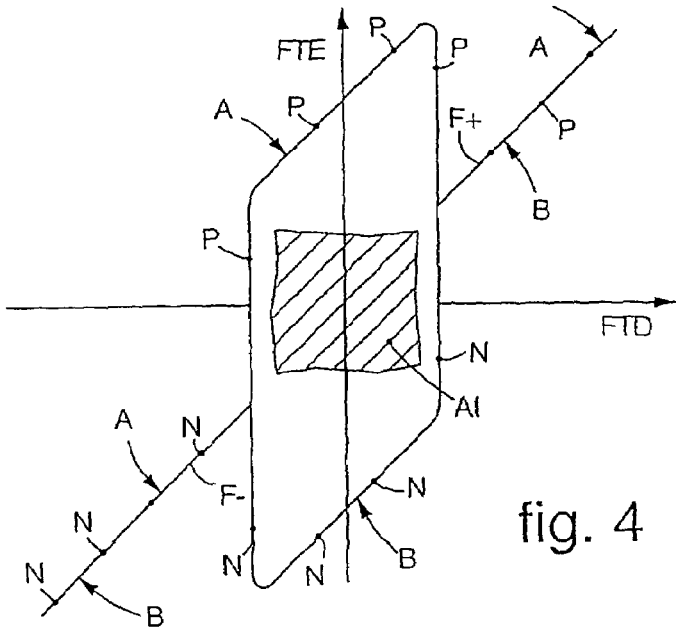
Figure 5A:
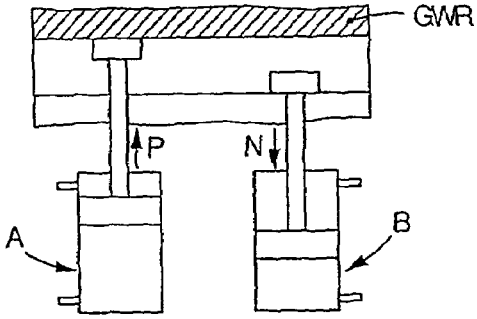
Figure 5B:
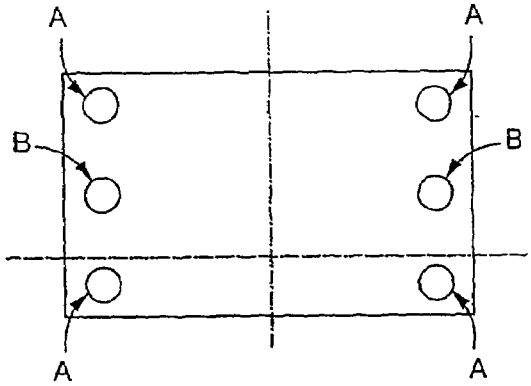
Figure 6:
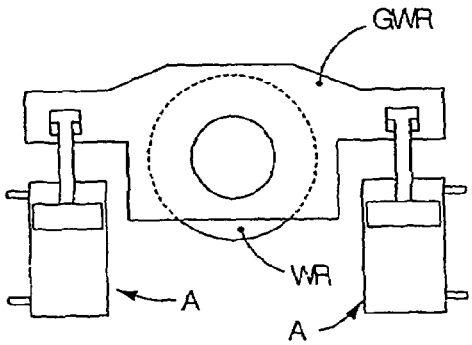
Figure 7:
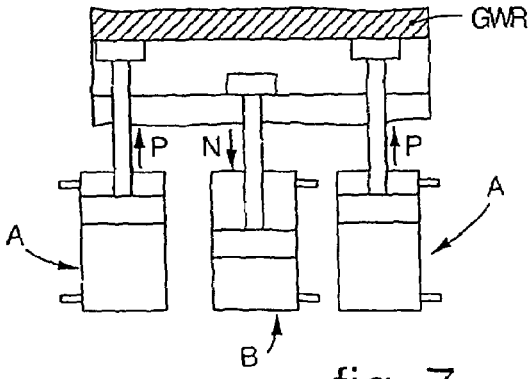
Figure 8:
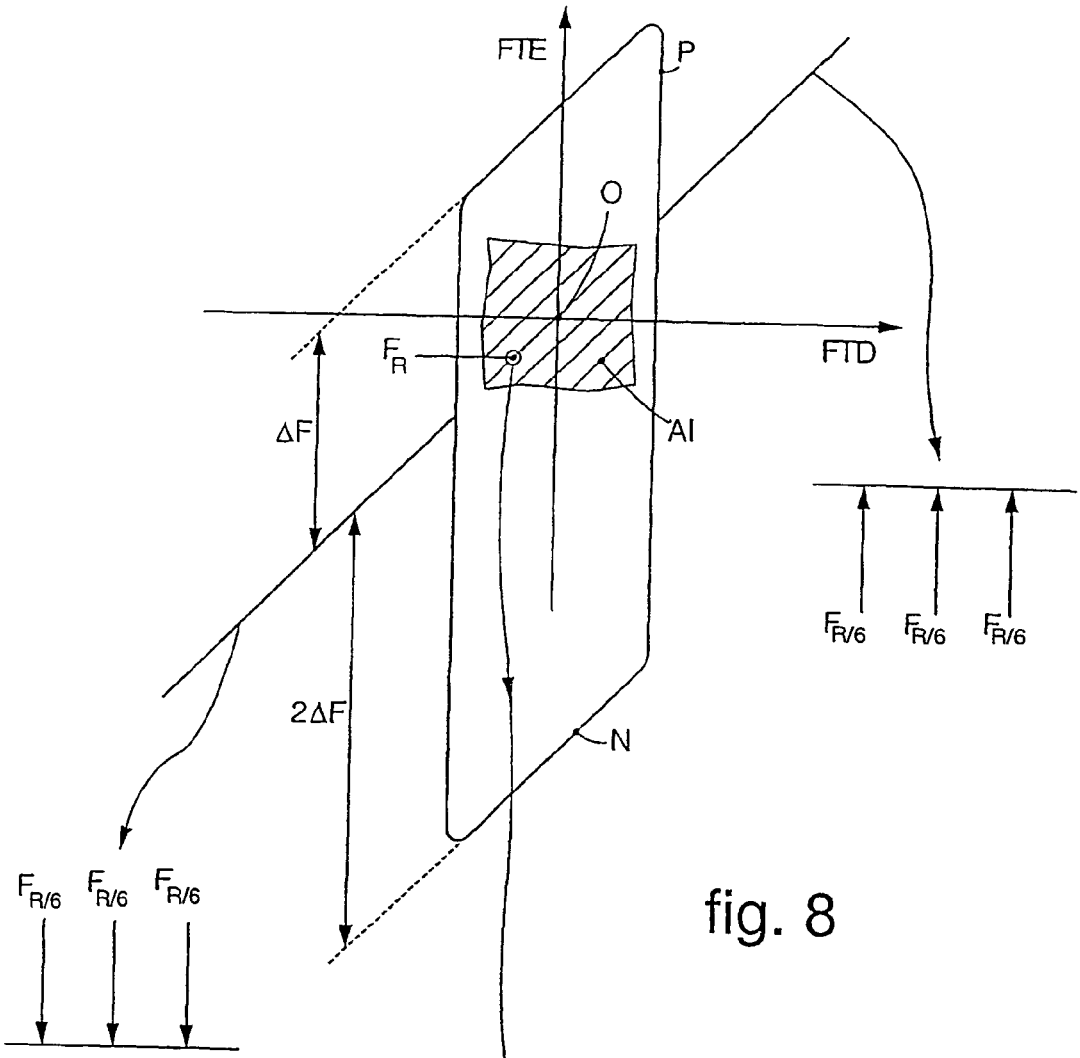
Figure 9:
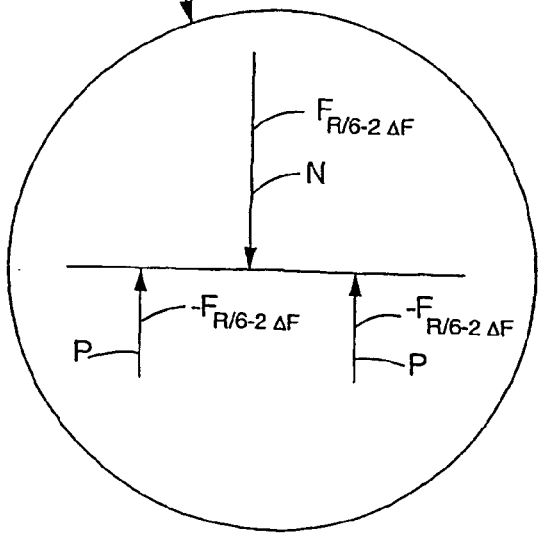
Figure 10:
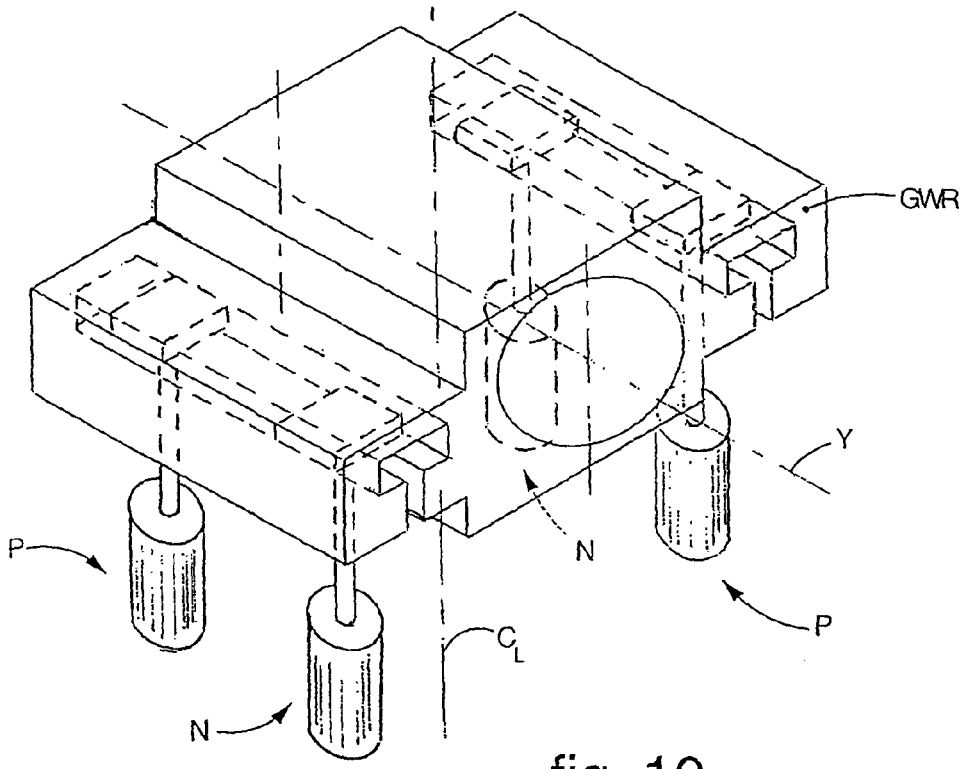
Figure 11:
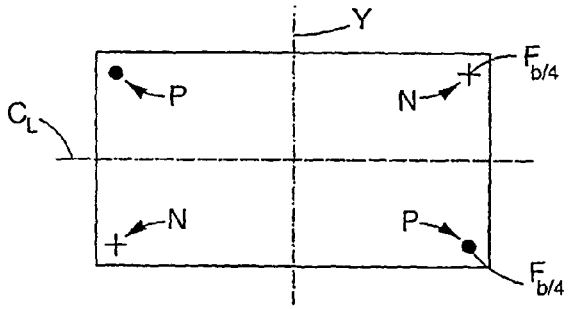
Figure 12:
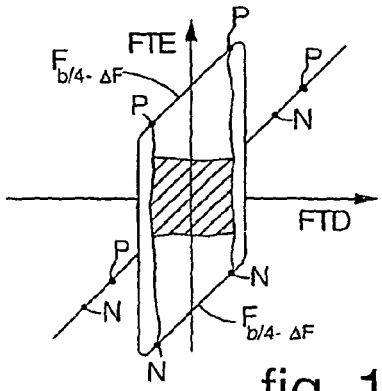
Figure 14:
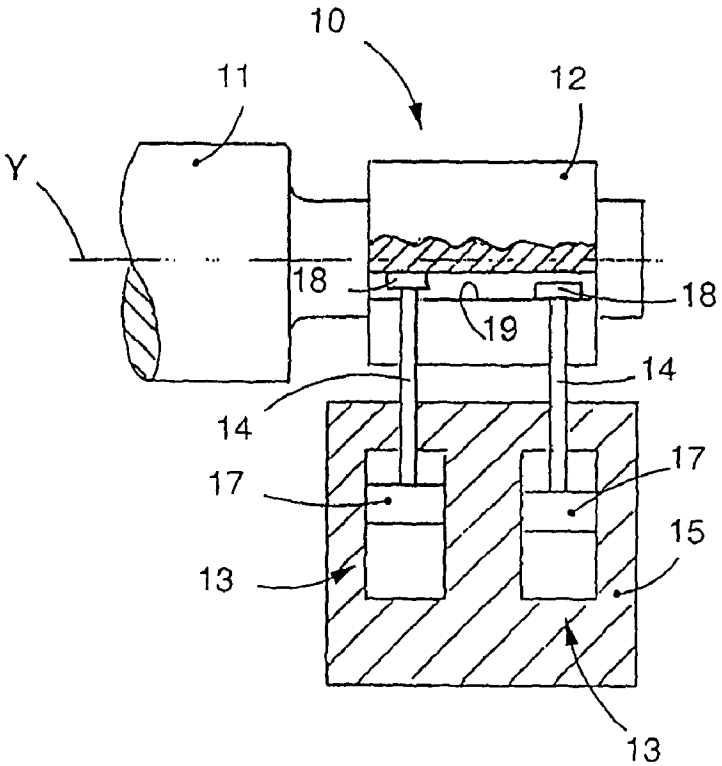
FIG. 14 is a part section along the line from A to A of FIG. 13.
Figure 13:
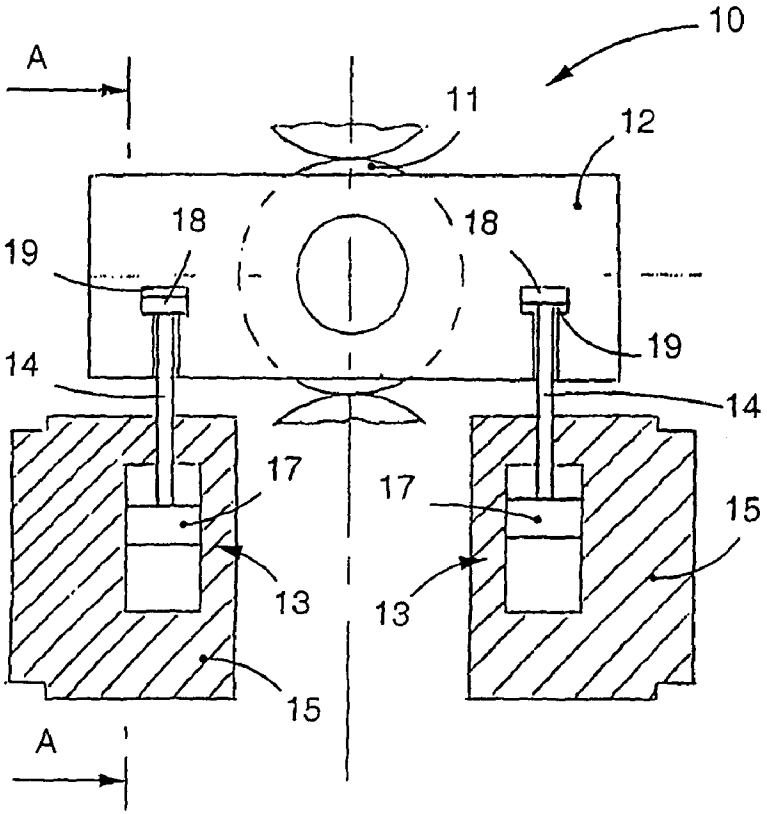
FIG. 13 is a schematic front view of a device as in FIG. 10.

With reference to FIGS. 13 and 14, a device 10 according to the invention is able to bend a roll 11, for example the working roll WR, in a rolling stand of a conventional type, with a pair of chocks 12 (only one of which is shown in the drawings) in which the ends of the roll 11 are assembled able to rotate.

The device 10 comprises, for each chock 12, a series of actuators 13 of the double-effect type, each of which comprises a cylindrical rod 14. In the example shown there are two actuators 13 for each lateral side of each chock 12.

Each series of actuators 13 is housed in a corresponding block 15 associated with the housing of the rolling stand. To be more exact, the block 15 is of the type fixed to the housing of the rolling stand, if the working roll WR is not subjected to axial shifting, or movable with respect to the housing, together with the corresponding working roll WR if the latter is able to shift axially.

Each rod 14 is connected with command means 17 of a conventional type, for example of the fluid-dynamic type and is provided, at one end opposite the command means 17, with a hammer head 18 which is housed with play in a through groove 19, made on the lateral sides of each chock 12.

The two grooves 19 are arranged on opposite sides with respect to the axis of rotation Y of the roll 11, they are substantially T-shaped in cross section and they are parallel so as to make it possible to remove the roll 11.

Each hammer head 18 of the actuators 13 is able to cooperate both with the upper surface and also with the lower surface of the corresponding groove 19. Moreover, the travel of the cylindrical rods 14 is wide enough both to bend the roll 11, either negatively or positively, and also to recover the play between the hammer heads 18 and the groove 19.

The actuators 13 can be commanded either individually or in homogeneous series, in one direction or the other, by the command means 17, to obtain wide bends of the roll 11, both in the static and dynamic step.

It is obvious however that modifications or additions can be made to the device to bend the rolls in a rolling stand as described heretofore, without departing from the spirit and scope of the invention.

It is also obvious that, although the invention has been described with reference to specific examples, a skilled person shall certainly be able to achieve many other equivalent variants, all of which shall come within the field and scope of this invention.

The invention claimed is:

1. Method to bend the rolls in a rolling stand, comprising:

rotatably mounting each roll to be bent in two corresponding chocks associated with command actuators of double-effect type, wherein said command actuators comprises hydraulic jacks with hammer heads, positioned within a longitudinal groove made on the lateral side of the relative chock and able to cooperate both with an upper surface and a lower surface of the corresponding longitudinal groove made on the lateral side of the corresponding chock, controlling the bending of the roll to be bent using at least four of said hydraulic jacks for each chock, said at least four hydraulic jacks being positioned on opposite sides with respect to an axis of rotation (Y) of said roll, to provide both a negative and a positive bending of the respective roll, wherein said controlling comprises moving said hammer heads to contact one of the upper surface and the lower surface of said groove, and concurrently, to control the bending force applied to said roll in an area of indetermination (AI) around a point of passage between a positive and a negative bending:

actuating at least one hydraulic jack with a force having the same sign of the desired bending and a value greater than necessary, and actuating a second at least one hydraulic jack with a positive bending force to balance the total resulting bending.

2. Method as in claim 1, comprising: a) preventing the hammer head hydraulic cylinder of each jack from working in an area of indetermination (AI) where friction and play make unsure the value of the force (F) actually transmitted by said command actuator to the chock; and b) maintaining the actual total bending force (FTE) aligned on the axis of the bearing of the roll to be bent.

3. Method as in claim 2, comprising acting on the pressures in each of the two chambers of the hydraulic jack (A, B) to apply both a negative and positive force.

4. Method as in claim 3, further comprising:

managing a configuration with four jacks for each chock a first jack (B), as the configuration approaches said area of indetermination (AI), with a greater than necessary negative bending force (F−), and concurrently, generating a greater positive bending force (F+) with a second jack (A), such as to balance the total result, so that the passage into the area of indetermination (AI) is performed with the play having been recovered.

5. Method as in claim 2, comprising using six hydraulic jacks (A, B) for each chock, so that no torque is generated in the bearing of the roll to be bent.

6. Method as in claim 2, comprising using four jacks (A) for each chock, the management of said jacks (A) being different between the inlet side of the rolling stand and the outlet side thereof, so that the resultant force on the bearing of the roll to be bent is still aligned with the intersection between the central axis ($C_L$) of the bearing and the axis of rotation (Y) of said roll to be bent.

7. Method as in claim 1, wherein three hydraulic jacks are positioned for each side of a relative chock, comprising, actuating for each side of the chock, two jacks in one direction and actuating the third jack in the opposite direction to maintain the actual total bending force aligned on the central axis ($C_L$) of the bearing of the roll to be bent.

8. Method as in claim 1, wherein two hydraulic jacks are positioned for each side of a relative chock, comprising managing said jacks (A) differently between the inlet side of the rolling stand and the outlet side thereof, so that the resultant force on the bearing of the roll to be bent is still aligned with the intersection between the central axis ($C_L$) of the bearing and the axis of rotation (Y) of said roll to be bent.

* * * * *